US005392836A

United States Patent [19]

West et al.

[11] Patent Number: 5,392,836

[45] Date of Patent: Feb. 28, 1995

[54] DOOR ASSEMBLY

[75] Inventors: Floyd D. West, Scales Mound, Ill.; John Olthafer, Dickeyville, Wis.; Mark S. Ungs; David R. Noon, both of Dubuque, Iowa

[73] Assignee: Rite Hite Corporation, Milwaukee, Wis.

[21] Appl. No.: 902,867

[22] Filed: Jun. 23, 1992

[51] Int. Cl.[6] ..... E06B 9/17

[52] U.S. Cl. ..... 160/273.1; 160/290.1

[58] Field of Search ..... 160/273.1, 268.1, 270, 160/271, 272, 290.1, 265, 310, 133, 276, 281, 288

[56] References Cited

U.S. PATENT DOCUMENTS

| | | | |
|---|---|---|---|
| 778,228 | 12/1904 | Dodge et al. . | |
| 1,550,237 | 8/1925 | Beckman . | |
| 1,972,182 | 9/1934 | Chamberlain et al. | 160/290.1 X |
| 2,406,272 | 8/1946 | Voorhees | 160/281 |
| 2,845,117 | 7/1958 | Barry . | |
| 3,149,665 | 9/1964 | Handford . | |
| 3,878,879 | 4/1975 | Manns . | |
| 4,478,268 | 10/1984 | Palmer . | |
| 4,601,320 | 7/1986 | Taylor . | |
| 4,649,981 | 3/1987 | Bibeau . | |
| 4,690,195 | 9/1987 | Taylor . | |
| 4,934,437 | 6/1990 | Kraeutler . | |
| 5,025,847 | 6/1991 | Mueller | 160/270 |
| 5,058,651 | 10/1991 | Ashley et al. . | |
| 5,078,197 | 1/1992 | Weishar . | |
| 5,123,474 | 6/1992 | Smith | 160/273.1 X |
| 5,129,442 | 7/1992 | Warner | 160/271 |
| 5,139,074 | 8/1992 | Warner | 160/271 |
| 5,219,015 | 6/1993 | Kraeutler | 160/271 |

FOREIGN PATENT DOCUMENTS

| | | |
|---|---|---|
| 0125217 | 11/1984 | European Pat. Off. . |
| 3245009 | 6/1984 | Germany . |
| 503774 | 4/1939 | United Kingdom . |
| 1444017 | 7/1976 | United Kingdom . |
| 2093895 | 9/1982 | United Kingdom . |

OTHER PUBLICATIONS

"Re-Coil-Away" Door System Installation instructions brochure, revised May, 1991.

*Primary Examiner*—David M. Purol

*Attorney, Agent, or Firm*—Leydig, Voit & Mayer Ltd.

[57] ABSTRACT

A door assembly is provided for use in proximity to door openings wherein there is a large amount of material handling vehicle traffic. The assembly includes a frame mounted within the door opening and having upright elongate side sections. Each section has an interior guideway with an elongate entry thereto. Within each section is a pair of guide members forming therebetween a gap aligned with the entry. A flexible door member is slidably mounted on the frame. Opposite marginal side segments of the door member extend through the entries and gaps into the section guideways. Each marginal segment is provided with a plurality of relatively spaced, vertically aligned follower elements normally impassable with respect to the gap. Upon an external force of at least a predetermined magnitude being exerted on an exposed surface of the door member while in a closed mode, the follower elements will exert a predetermined wedging force on the gap-forming portions of the guide members causing a change in the relative dimensions of the gaps and follower elements allowing the follower elements to pass through the gaps and effect at least partial disassembly of the door member from the frame. Each section is provided with an adjustable panel which may be selectively adjusted to an open position exposing the guideway thereby permitting the follower elements to be reassembled in the respective guideway.

7 Claims, 5 Drawing Sheets

FIG. 1
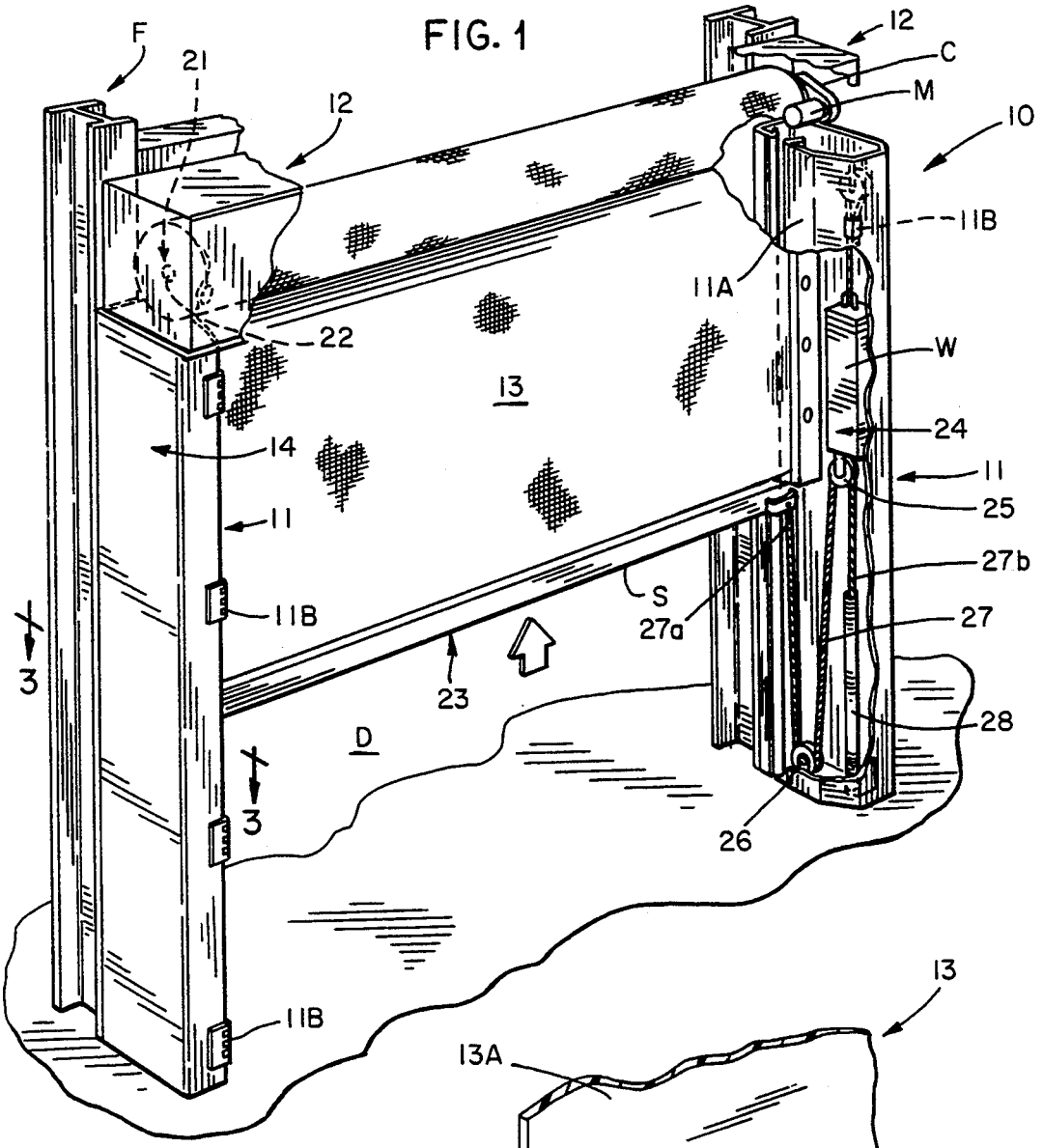
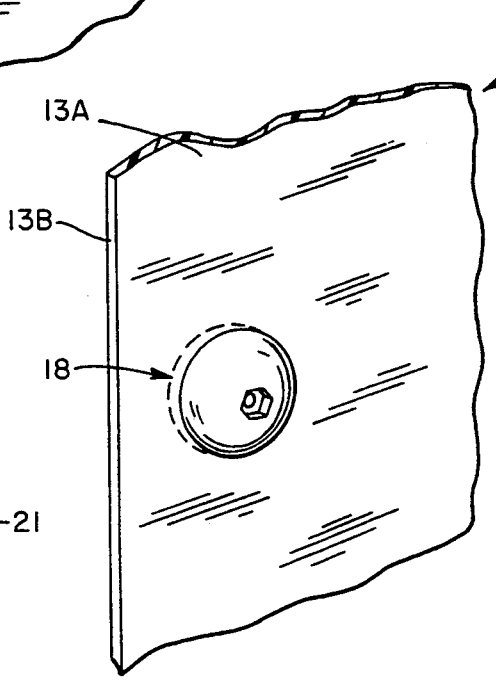
FIG. 2
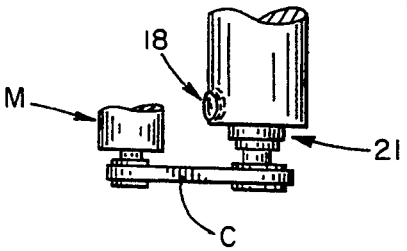
FIG. 4

DOOR ASSEMBLY

The invention relates to a break-away type of door member which will become disassembled from a frame mounted in proximity to a door opening, when an external force above a predetermined magnitude is exerted on an exposed area of the door member.

BACKGROUND OF THE INVENTION

Door assemblies, when installed in proximity to door openings where there is high material-handling vehicle traffic, are frequently accidentally or carelessly struck by such vehicles when the opening is fully or partially closed. In order to compensate for these conditions, various prior door assemblies were developed wherein the door members thereof were of the breakaway type, that is to say the door member would be disassembled from the frame structure with a minimal amount of damage to various components of the assembly. An example of such a breakaway type of door assembly is disclosed in U.S. Pat. No. 5,058,651 dated Oct. 22, 1991; however, such patent fails to disclose a means whereby the door 10, 110, if disassembled from the guides 14, 114, may be readily reassembled with such guides without difficult maneuvering or substantial portions of the assembly and door frame work being dismantled. Such maneuvering or dismantling is a costly, time-consuming operation and normally requires an inordinate amount of manual labor.

Where such types of prior door assemblies are utilized in proximity to an outside door opening, it is difficult to interfit the door member and associated frame in such a way as to avoid leaks or annoying drafts around the door area. In addition to such annoying drafts, where the door member of the prior assembly is of a flexible material, serious and distracting vibration noises develop particularly when the door member is buffeted by wind gusts or driving rain or snow causing the door member material to flutter.

SUMMARY OF THE INVENTION

Thus, an improved door assembly is provided which is of simple, yet sturdy construction; may be readily installed; is easily serviced and maintained; and is attractive in appearance. Furthermore, the improved door assembly may be utilized for door openings varying in size and shape over a wide range and may be readily secured in a closed mode when desired.

Additional virtues and advantages inherent in the improved door assembly will become apparent from the description, accompanying drawings and appended claims.

In accordance with one embodiment of the invention, a door assembly is provided which is particularly suitable for use in proximity to door openings provided in commercial and manufacturing facilities wherein there is high material handling vehicle traffic. Such openings are normally located at loading docks, or in interior partition walls separating or segregating various areas within a plant or warehouse. The improved assembly includes a frame disposed in proximity to the designated door opening, and a flexible door member slidably mounted within the frame for movement between open and closed modes. The frame is provided with a pair of side sections disposed on opposite sides of the door opening. Each side section includes an upright housing extending substantially the full height of the door opening and having an elongate interior guideway. The housing is provided with an elongate entry communicating with the adjacent guideway and extending substantially the full height thereof. Disposed within each housing are guide members which cooperate with one another to form a narrow gap which is aligned with the entry.

When the door member is in assembled relation with the frame, marginal segments of the door member extend through the gaps and terminate within the housing guideways. Each marginal segment is provided with a plurality of longitudinally spaced, vertically aligned follower elements. The follower elements are impassable with respect to an adjacent gap because of the normal relative dimensions of the gap and follower elements. Where, however, an external force of at least a predetermined magnitude is exerted on an exposed surface of the door member, the follower elements will exert a wedging force on the gap-forming portions of the guide members causing a change in the relative dimensions of the gap and follower elements allowing the latter to pass through the gap and effect at least partial disassembly of the door member from the frame.

The housing of each frame side section is provided with a hinged panel which may be selectively adjusted to an open position exposing substantially the full height of the interior guideway. While the housing panel is in the open position, the marginal segment and associated follower elements may be readily reassembled in the guideway or serviced as the case may be. A locking means is provided for selectively securing the door member in a closed mode.

DESCRIPTION OF THE DRAWINGS

For a more complete understanding of the invention, reference is made to the drawings, wherein:

FIG. 1 is a fragmentary perspective view of one embodiment of the improved door assembly shown mounted adjacent to a door opening; portions of the door assembly being cut away.

FIG. 2 is an enlarged fragmentary perspective view of a marginal segment of the door member shown in FIG. 1.

FIG. 4 is a fragmentary top plan view of the driven end of the drum-like member on which the upper edge portion of the door member is attached and showing the drive motor connected thereto.

DESCRIPTION

Figure 3:
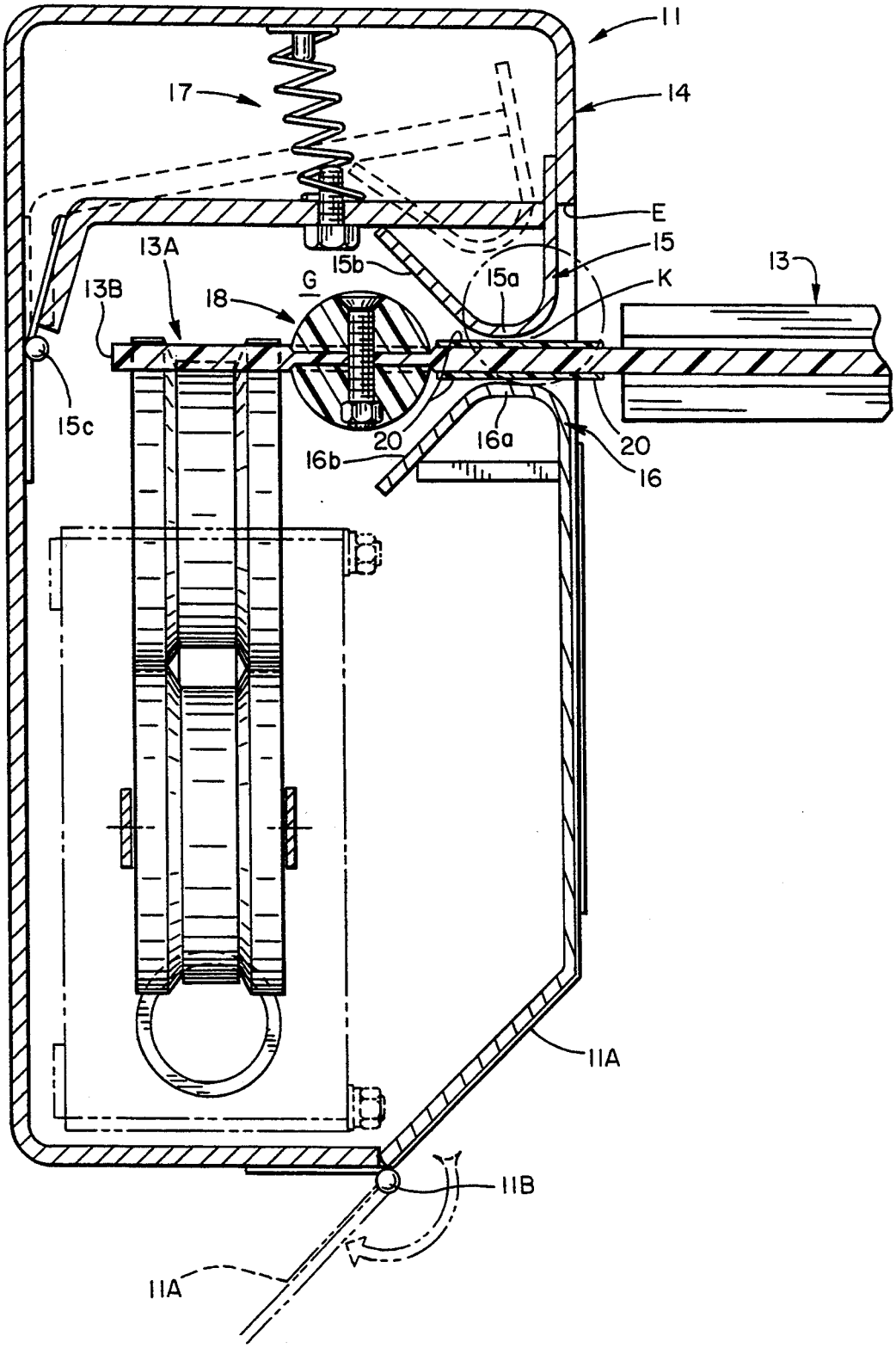
FIG. 3 is an enlarged fragmentary sectional view taken along line 3—3 of FIG. 1 and showing in phantom lines the hinged housing panel in an open position.

Referring now to the drawings and more particularly to FIG. 1, one embodiment of the improved door assembly 10 is shown adjacent to a door opening D provided in a commercial building, plant, warehouse or the like. The door opening D may be formed in an outside wall, such as at a loading dock or in an interior wall. The door assembly 10 includes a frame F having a pair of upright side sections 11, disposed on opposite sides of the opening D, and a header 12 disposed above the opening D and interconnecting the upper ends of the side sections. A door member 13 is slidably mounted on the frame F for selective movement between open and closed modes. The door member may be formed of a flexible fabric-like material which is durable, water resistant, thermal insulative and capable of withstanding substantial impact without tearing or rupturing. The door member should remain flexible when subjected to extreme climatic conditions.

Each side section 11 is preferably of similar construction and, as seen in FIGS. 1 and 3, includes an upright housing 14, which extends substantially the full height of the door opening and is provided with an elongate interior guideway G. The side of the housing facing the other side section is provided with an entry E in communication with the guideway. A panel 11A of the housing defining at least in part the entry E is hinged at 11B so that it may be selectively adjusted to a fully open position, shown in phantom lines in FIG. 3. When in such position substantially the entire length of the guideway G, as well as the remainder of the housing interior are exposed. The importance of this feature will be discussed more fully hereinafter.

Disposed within each housing interior are guide members 15 and 16 having portions 15*a*, 16*a* thereof which cooperate with one another to form a narrow gap K normally having a first dimension. The gap is in registered or aligned relation with the entry E. Each guide member may have an inwardly flared portion 15*b*, 16*b* which defines in part a surface of guideway G.

As seen in FIG. 3, guide member 15 is hinged at 15*c* to an interior surface portion of housing 14 and is biased by spring 17 so that portion 15*a* will cooperate with portion 16*a* to form the gap K. If desired, guide member 15 may be fixed to the housing interior in which case guide member 16 would be slidably mounted on the interior surface of panel 11A and be biased by a spring, not shown, towards the other guide member 15.

Door member 13 normally has a substantially rectangular configuration which is of such size that, when the member is in the closed mode, the door opening D will be completely covered by the member. The side marginal segments 13A of the door member, when the latter is properly assembled with the frame, extend laterally through the corresponding gaps K and terminate within the respective housing interior, see FIG. 3. Each marginal segment 13A is provided with a plurality of longitudinally spaced, vertically aligned follower elements 18. The elements may be of sectional design with each section having a semi-spherical configuration or various other profile configurations which cause the elements to be impassable with respect to the gaps K when each of the latter has a first dimension. The elements 18 may be of a suitable hard plastic material which will readily slide over the exposed surfaces of guide member portions 15*b*, 16*b* when the door member moves between the open and closed modes. On the other hand, the elements 18 may be formed of a compressible material which will compress under a predetermined pressure produced by an external force of a wind gust or a vehicle impacting on the exposed surface of the member 13 when in a closed mode. Where the follower elements are of a compressible material, both guide members 15, 16 may be fixed within each housing.

In the illustrated embodiment, the follower elements 18 are of a suitable hard material and the exterior configuration of each element is such that, when the element exerts a predetermined wedging force against the guide member portions 15*b*, 16*b*, a camming action occurs causing the guide member 15 to overcome the bias of spring 17 enlarging gap K to a second dimension, shown in phantom lines in FIG. 3, allowing the follower element to pass through the enlarged gap whereupon the door member is at least partially disassembled from the frame side sections 11.

The portion of the marginal segment normally disposed within gap K may be provided with wear strips (not shown) which would serve a dual function; namely, to reduce material wear and to minimize sliding friction between the guide members and the door member.

As seen in FIGS. 2 and 3, the follower elements 18 are set in from each side edge 13B of the door member so that, when the member is assembled with the side sections, the edge of the marginal segment is disposed within the guideway G a substantial distance from the gap whereupon the possibility of leaks or drafts occurring around the periphery of the member 13 is virtually eliminated.

The upper marginal edge of the door member 13 may be affixed to an elongate drum-like member 21 which is mounted for rotation about a transversely extending horizontally disposed shaft 22. The drum-like member 21 is disposed within header 12. At least one end of shaft 22 may be power driven by a reversible electric motor M through a chain drive C, see FIG. 4. The actuation of the motor and the direction of rotation thereof are manually regulated by remote controls, not shown, located proximate the door opening D.

The lower marginal edge of door member 13 is attached to an inflexible, elongate bar 23 which substantially spans the distance between the frame side sections, see FIG. 1. The underside of bar 23 may be provided with suitable weather stripping S which resiliently engages the floor of the door opening when the door member is in the fully closed mode.

A counter-balancing unit 24 may be provided within each side section housing, only one being shown in FIG. 1, which assists in moving the door member 13 between the open and closed modes. The unit 24 includes a plurality of individual weights W which may be arranged in stacked relation. The number of weights in the stack determines the extent of the counter-balancing effect desired. As seen in FIG. 1 a sheave 25 may be attached to the underside of the stack of weights. A second sheave 26 is fixedly attached to a bottom section of the housing. A flexible cable 27 engages the sheaves and has one end 27*a* connected to one end of bar 23 and the other end 27*b* connected to one end of a coil spring 28. The other end of the spring is fixedly connected to the bottom panel of the housing. The length and strength of spring 28 are predetermined so that the door member is continually under tension thus, maintaining the exposed portion of the door member in a taut condition. By maintaining the exposed door member portion in a taut condition, the problem of flutter of the material forming the door member is substantially avoided and vibration noises attributed thereto are eliminated or significantly diminished and the overall appearance of the door member is enhanced.

The opposite ends of bar 23 may be provided with lock components (e.g. sliding bolt) which coact with complemental lock components provided at the bottom section of each housing and securely lock the door member 13 in a fully closed mode. One of the lock components at each housing may be key-actuated.

When the marginal segments 13A of the door member has become disassembled from the side sections, the hinged panel 11A of each housing is manually adjusted to the open, or inoperative, position, see phantom lines in FIG. 3. When the panel 11A is in such a position, the full height of guideway G is uncovered, whereupon the portions 15*a*, 15*b* of guide member 15 are exposed enabling the follower elements 18 along each marginal segment to be realigned with the guide member portion 15*a*. At the same time any adjustment or servicing of the counter-balancing and tensioning components may be readily attended to. Thus, once the reassembling and/or servicing operations have been completed, the housing panel 11A is once again adjusted to its normal closed position, as shown in full lines in FIG. 3. Suitable fasteners, not shown, may be provided for retaining the hinged panel 11A in a closed position. By reason of the housing panel 11A being hinged, the reassembling and/or servicing of the door assembly is greatly simplified and may be readily accomplished in a facile and expeditious manner.

While the improved door assembly 10 has heretofore being described with the header 12 disposed above the door opening, in some instances it may be located in a trench, not shown, provided in the floor. In such an arrangement, the drum-like member 21 would be disposed beneath the floor level and the door member 13 would be pulled upwardly to effect closing of the door opening. In another version of the improved door assembly, the door member in lieu of being attached to the drum-like member 21 may move upwardly in an unrolled condition within an upright narrow pocket which may be mounted vertically above the door opening. In this latter arrangement, substantial vertical headroom would be required above the door opening to accommodate the narrow pocket.

Referring now to FIGS. 5–8 a second embodiment of an improved assembly 110 is shown. Components of assembly 110 which are comparable to components of assembly 10 will have similar identifying numbers but in the 100 series.

Figure 7:
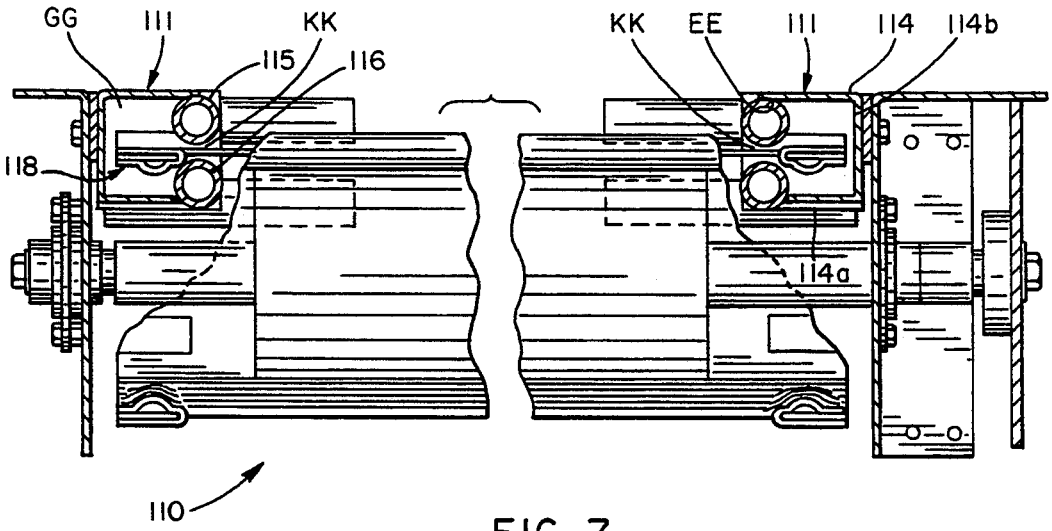
FIG. 7 is a fragmentary top plan view of FIG. 5.

Assembly 110 embodies a frame FF, see FIG. 7, having a pair of upright side sections 111 fixedly mounted on opposite sides of the door opening D and extending substantially the full height of the door opening. Each side section is preferably of like configuration and includes a channel-shaped housing 114 having an open side, see FIG. 7, facing the other side section and defining an entry EE extending the full length of the housing. Positioned within each entry is a pair of upright, substantially parallel guide members 115, 116 which form therebetween a gap KK of a predetermined fixed dimension, which is aligned with the entry EE. Guide member 116 is secured to an access panel 114*a* of a housing 114 forming one leg of the channel-shaped housing. Panel 114*a* may be manually removed from the remainder 114*b* of the housing, as will be described more fully hereinafter when the door assembly is to be serviced.

Figure 5:
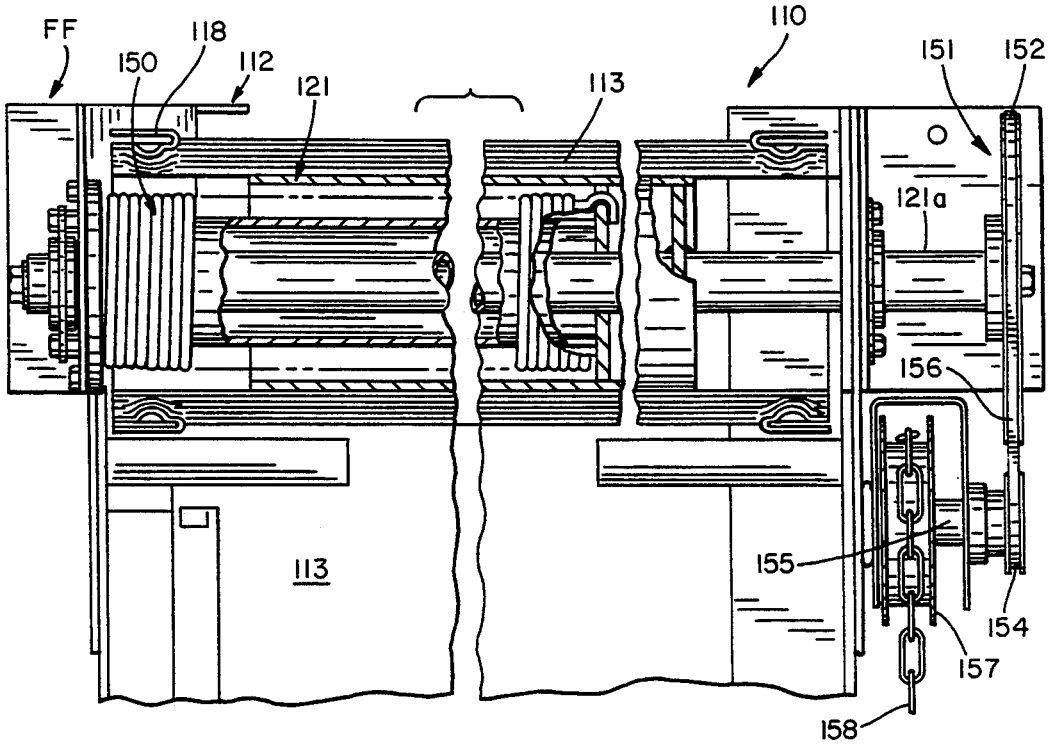
FIG. 5 is a fragmentary, enlarged front elevational view of a second embodiment of the improved door assembly with portions thereof removed so as to expose otherwise concealed components thereof.
Figure 6:
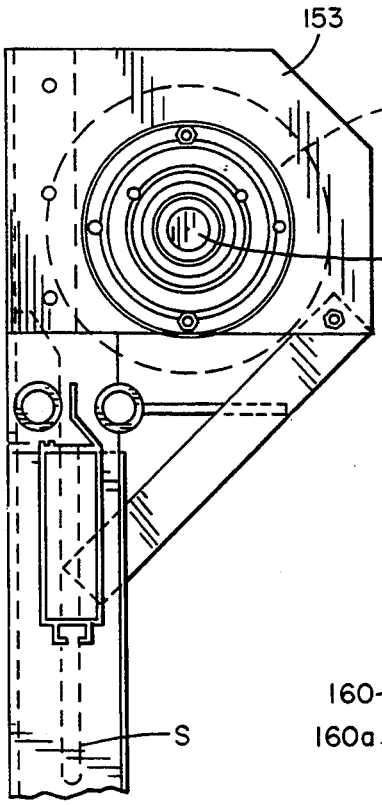
FIG. 6 is a fragmentary left end elevational view of FIG. 5.

Frame FF includes a header 112 which is disposed above the door opening and interconnects the upper end portions of the side sections 111. Rotatably mounted within header 112 is an elongate drum or spool 121 on the periphery of which the upper edge portion of a flexible door member 113 is secured. Depending upon the direction of rotation of the drum, the door member 113 will move to either an open mode or a closed mode relative to the door opening. As seen in FIG. 5, the drum may be provided with a balance spring 150, preferably of a coil configuration, having an axis thereof aligned with the axis of rotation of the drum itself. The size and tension of spring 150 are predetermined so that raising and lowering of the door member 113 may be readily accomplished with a small amount of manual effort.

Figure 8:
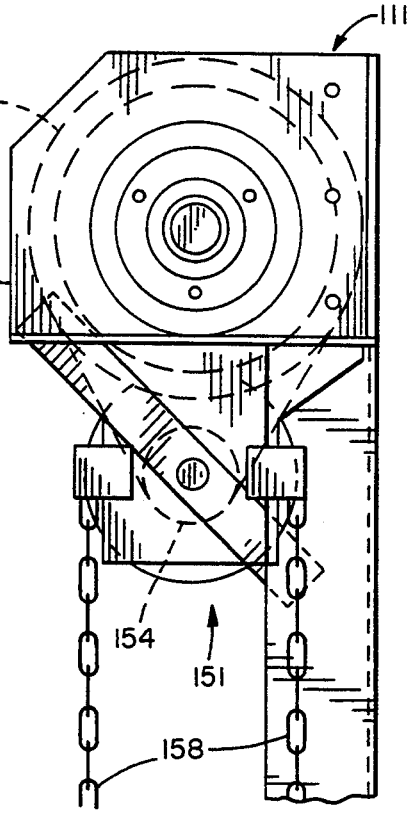
FIG. 8 is a fragmentary right end elevational view of FIG. 5.

As seen in FIGS. 5 and 8, rotation of drum 121 may be accomplished by a chain and sprocket wheel assembly 151 which is mounted on the upper end portion of one of the side sections 111. As seen in FIG. 8, a first sprocket wheel 152 is keyed to one end of the drum shaft 121*a*. The shaft ends are supported by brackets 153, see FIGS. 6 and 8; each bracket being secured to the upper portion of the side section. Mounted in vertical alignment beneath sprocket wheel 152 is a smaller diameter second sprocket wheel 154 which is keyed to a stub axle 155. The wheels 152 and 154 are interconnected by a first continuous chain section 156. Also keyed to the stub axle is a third sprocket wheel 157 which is engaged by a second continuous chain section 158. The chain section 158 depends from sprocket wheel 157. The lower end of chain section 158 does not require further support, but may, if desired be restrained from lateral movement, e.g., swinging, by means such as a sprocket, pulley, or channel, not shown, the latter means being mounted at or near the bottom of the side section. The vertical portions of chain section 158 are exposed and may be readily grasped to effect rotation of the drum and movement of the door member 113 to either the open or closed mode. Access to the chain vertical portions may for reasons of security be restricted to one side (e.g. inside) of the door member 113. A suitable lock mechanism, not shown, may be utilized for locking one chain vertical portion to a fixed portion of the adjacent housing 114.

Figure 12:
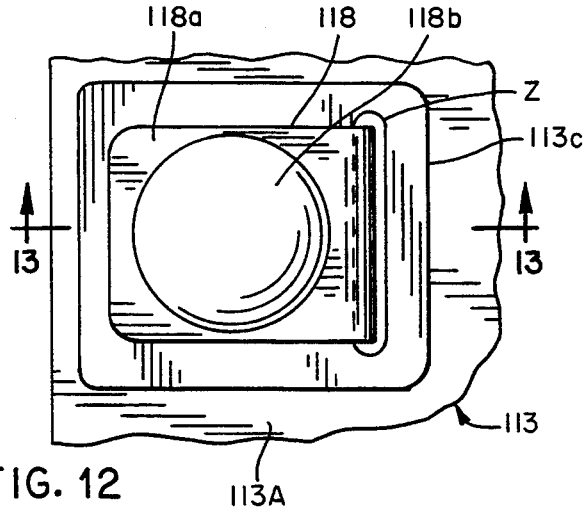
FIG. 12 is an enlarged front elevational view of one embodiment of a follower element carried on a side marginal segment of the door member.
Figure 13:
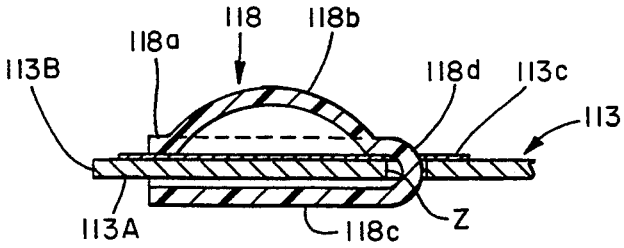
FIG. 13 is a sectional view taken along line 13—13 of FIG. 12 but showing the follower element mounted on a marginal segment of the door member.

Like door member 13, member 113 has mounted on the side marginal segments 113A a plurality of vertically spaced follower elements 118. Each element 118 may have a shape as seen in FIGS. 12, 13. In the illustrated embodiment, element 118 is a substantially U-shaped clip with one leg 118*a* thereof provided with an outwardly extending protuberance 118*b*. The opposite leg 118*c* of the clip is substantially flat, see FIG. 13. The spacing between the legs is sized to accommodate the material thickness of the marginal segment 13A of the door member 113. The marginal segment of the door member 113 is provided with a plurality of vertically spaced slots Z, one for each follower element. The slot is shaped to accommodate a bail section 118*d* of the element 118. The slots are set in from the marginal edge 113B of the door member so that when the door member is assembled on the frame the edge will be disposed well within the interior guideway GG of the frame channel-shaped housing 114. Preferably, a reinforcing patch 113C is mounted on one or both sides of door member 113 to reinforce the area around the slot Z and the follower element 118. See FIGS. 12 and 13.

Each follower element is preferably formed of strong yet distortable plastic material. The normal overall dimension of the follower element measured perpendicular to leg 118*c* and through the zenith of protuberance 118*b* is greater than the spacing between the stationary guide members 115, 116. Thus, in order for the follower elements 118 to pass between the guide members, the protuberances 118*b* of the follower elements must be distorted sufficiently so as to reduce the normal overall dimension. Such distortion occurs only when a wedging force above a predetermined amount is exerted on the guide members by the follower element protuberances. This will occur before the door member and frame are structurally damaged.

Figure 10:
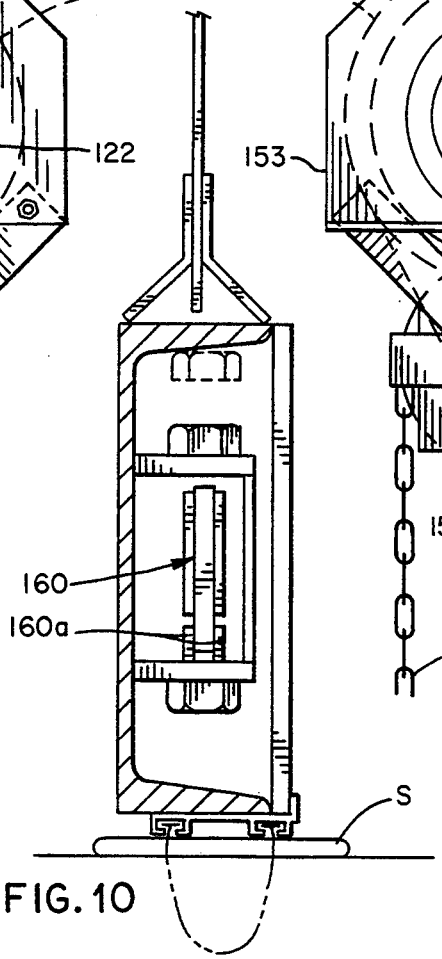
FIG. 10 is a fragmentary, left end elevational view of FIG. 9 and showing the door member in a closed mode; a weather stripping piece carried along the bottom edge of the door member being shown in phantom lines in an inoperative condition which occurs when the piece is in non-engagement with the bottom surface of the door opening in which the door assembly is mounted.
Figure 9:
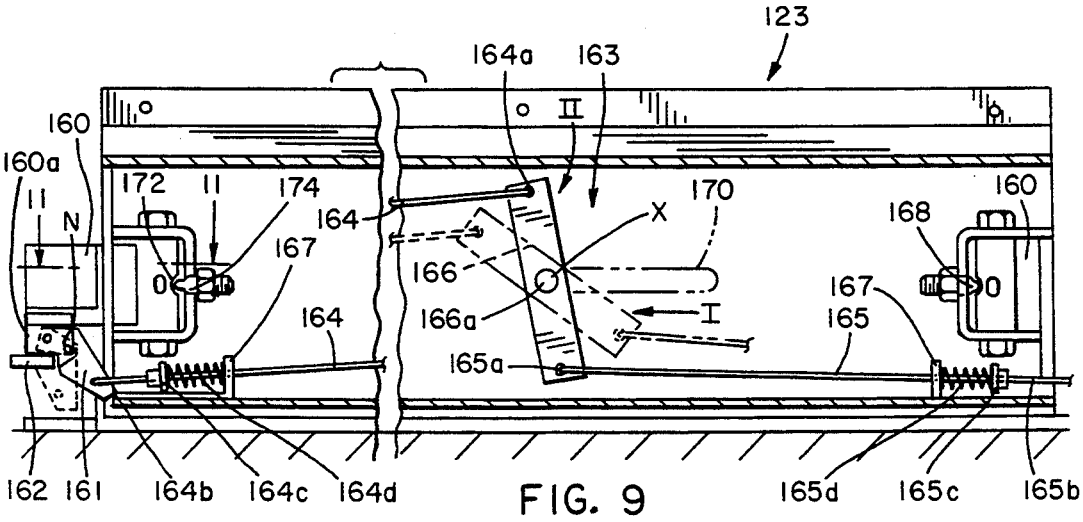
FIG. 9 is a fragmentary enlarged front elevational view of the lower portion of the door member shown in a closed mode and with a cover panel partially removed thereby exposing complemental lock components in an unlocked relation; one lock component being shown in phantom lines in an interlocking relation.
Figure 11:
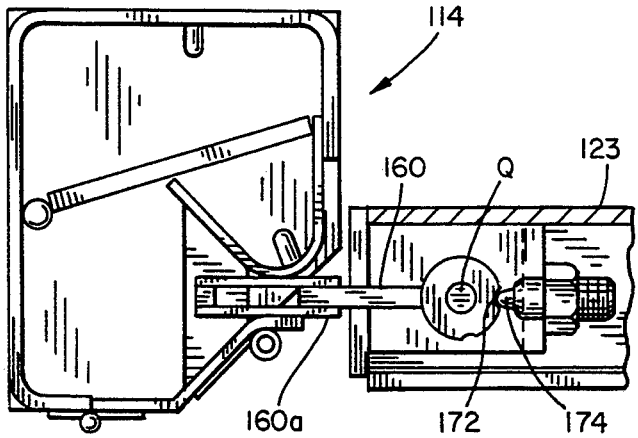
FIG. 11 is a fragmentary enlarged sectional view taken along line 11—11 of FIG. 9 and including a lower portion of a frame side section.

As seen in FIGS. 9–11, the bottom portion of the door member is provided with an elongated bar 123 which spans the distance between the side section housings 114. Projecting endwise from opposite ends of the bar are tab-like brackets 160. Depending from each bracket 160 is a pair of tongues 160*a* between which is pivotally connected a lock component 161, see FIG. 9. The lock component 161 is provided with a peripheral notch N which is adapted to lockingly accommodate a stationary complemental lock component 162, mounted on the bottom portion of the side section, see FIG. 9, when the door member assumes its closed mode. Lock component 161 is biased to assume a locking position by a spring-loaded release mechanism 163 which is adjustably mounted on bar 123.

Mechanism 163 includes a pair of elongate cables 164, 165, each having a corresponding end 164*a*, 165*a* thereof pivotally connected to an actuating arm 166, the latter having its midlength 166*a* mounted on the bar 123 for pivoting about axis X, see FIG. 9. The opposite corresponding ends 164*b*, 165*b* of the cables are pivotally connected to the adjacent lock component 161. Each cable is provided with a collar 164*c*, 165*c* which is affixed to the cable and moves therewith. Spaced inwardly from the corresponding cable collar and affixed to the bar 123 is a slotted bracket 167 through which a segment 164*d*, 165*d* of the cable is adapted to slidably extend. Encompassing a portion of each cable disposed between the respective collar 164*e*, 165*e* and bracket 167 is a bias spring 168 which exerts the biasing force on the adjacent lock component 161.

A crank handle 170 is connected to actuating arm 166 for pivoting same about the arm axis X. When handle 170 is rotated in a clockwise direction about axis X the actuating arm will move in a like direction from position I (phantom lines, FIG. 9) to position II causing the cable ends 164*b*, 165*b* to be retracted and moving the lock components 161 to release positions with respect to the stationary lock components 162. The lock components 161 in the release position are shown in full lines and in the locked position in phantom lines in FIG. 9.

As seen in FIGS. 9 and 11, each bracket 160 is mounted on the adjacent end portion of the bar 123 so as to pivot about a fixed axis Q. The bracket has a recess 172 which is engaged by a ball detent 174 to releasably retain the bracket in its operative position. Upon impact the bracket rotates about axis Q to release the door. By reason of the pivotal mounting of the brackets 160, the latter may readily slide past the guide members formed in the side sections when the door member is subjected to an exterior force above a predetermined amount due to impact of a vehicle or the like without damaging the door member or side sections. In the alternative, the bracket 160 may be formed of a resilient material thus eliminating the need for the pivot mechanism including detent 174.

Figure 14:
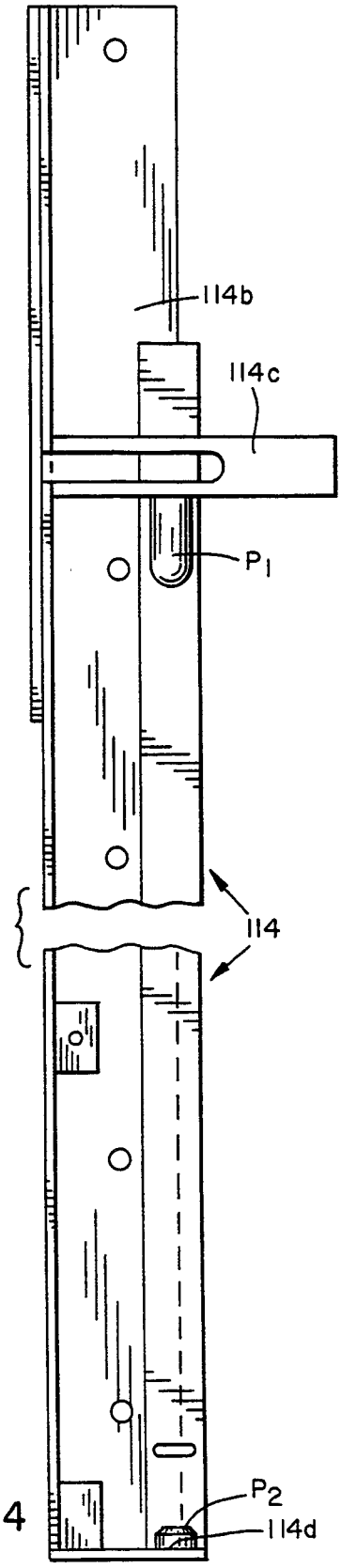
FIG. 14 is a fragmentary, elevational view, on a reduced scale, of one of the frame side sections per se and with a removable vertical panel thereof removed.

As aforementioned, the panel 114*a* of housing 114 of each side section may be manually removed from the remainder of the housing when the marginal segments 113A of the door member 113 are to be re-assembled with the side sections 111 or the assembly is to be serviced. To permit such removal, the upper and lower portions 116*a* and 116*b* of the guide member 116, respectively, are engaged by vertically aligned stationary pintles $P_1$ and $P_2$, see FIG. 14. Pintle $P_1$ is disposed above pintle $P_2$ and has a greater longitudinal length than pintle $P_2$ and is fixedly secured to a mounting bracket 114*c* provided on the portion 114*b* of the housing 114. The shorter pintle $P_2$ is affixed to a bottom panel 114*d* of the housing. Each pintle has a cylindrical configuration and an outside diameter dimension relative to the inside diameter of the open ends of guide member 116 so as to provide a sliding rotational fit between the panel 114*a* and the pintles. Thus, to remove housing panel 114*a* from the remaining portion 114*b* of the housing, panel 114*a* is manually pivoted outwardly away from portion 114*b* about the pintles $P_1$, $P_2$ as an axis and then panel 114*a* is raised or lifted relative to the pintles until the lower end of the guide member 116 is above the top of lower pintle $P_2$. When this occurs, the lower end of panel 114*a* may be laterally offset a slight amount so to clear the lower pintle. There is enough tolerance between the upper pintle $P_1$ and the end opening of guide member 116 to permit the aforementioned lateral offsetting.

A suitable handle, not shown, may be provided on the exterior of housing panel 114*a* to facilitate manual manipulation thereof. Furthermore, suitable locking means may be provided on panel 114*a* for retaining same in an assembled relation with housing portion 114*b*.

Thus, a simple, yet sturdy and attractive door assembly has been disclosed which may be readily serviced and maintained and when necessary enables the door member to be readily and easily reassembled with the frame.

What is claimed is:

1. An edge-retention system for use in a door assembly mounted in proximity to a door opening, the door assembly including a stationary frame having a pair of upright side sections for disposition on opposite sides of the door opening, each frame side section including a longitudinally extending interior guideway and a narrow entry gap aligned with the guideway; the door assembly also including a flexible door member mounted within the frame for movement between open and closed modes, said door member having opposed marginal segments which extend through the entry gap and terminate within said guideway; the edge retention system comprising:

a plurality of longitudinally spaced substantially vertically aligned follower elements, a series of said elements being mounted on each marginal segment of the door member and adapted to be slidably disposed within the guideway of the adjacent frame side section each follower element comprising a generally u-shaped clip including a first, flat leg, a second leg and a bail section, the legs being spaced to accommodate the material thickness of the marginal segments and the bail section being adapted to be received in a slit in the marginal segment of the door member, the second leg including a distortable protuberance, such that; when said door member and frame side section are in assembled relation, said follower elements are normally impassable through the entry gap and when an external force of at least a predetermined magnitude is exerted on an exposed area of said door member, said follower elements exert a predetermined wedging force on the entry gap causing the protuberances to deform and thereby allowing the follower elements to pass through the gap and effect at least partial disassembly of said door member from said frame; and a break-away bar including an elongate bar attached to a bottom edge of the door member and also including a pair of projecting tabs projecting from opposite ends of the elongate bar, and extending into the adjacent gap, each tab being movable to a position wherein the tab slides out of engagement with the gap when the door member is subjected to an external force above a predetermined magnitude.

2. The edge retention system of claim 1, wherein the protuberances of the follower elements are semi-spherical.

3. The edge retention system of claim 1 wherein said follower elements are removably mounted on the door member marginal side segments.

4. The edge retention system of claim 1, wherein the projecting tabs are made of resilient material, such that the tabs bend to allow the tabs to slide out of engagement with the respective gaps.

5. The edge retention system of claim 1, wherein the projecting tabs are pivotally mounted to the elongate bar, such that the tabs pivot to allow the tabs to slide out of engagement with the respective gaps.

6. An edge-retention system for use in a door assembly mounted adjacent a door opening, the door assembly including a frame having a pair of upright side sections each including a longitudinally extending interior guideway having an entry gap aligned with the guideway, the door assembly including a flexible door member mounted within the frame for movement between open and closed modes, the door member having opposed marginal segments which extend through the entry gap and terminate within the guideway; the edge retention system comprising:

a plurality of longitudinally spaced substantially vertically aligned follower elements, a series of said elements being mounted on each marginal segment of the door member and adapted to be slidably disposed within the guideway of the adjacent frame side section, each follower element comprising a generally u-shaped clip including a first, flat leg, a second leg and a bail section, the legs being spaced to accommodate the material thickness of the marginal segments and the bail section being adapted to be received in a slit in the marginal segment of the door member, the second leg including a distortable protuberance, such that when said door member and frame side section are in assembled relation, said follower elements are normally impassable through the entry gap and when an external force of at least a predetermined magnitude is exerted on an exposed area of said door member, said follower elements exert a predetermined wedging force on the entry gap causing the protuberances to deform and thereby allowing the follower elements to pass through the gap and effect at least partial disassembly of said door member from said frame.

7. The edge retention system of claim 6, wherein the protuberances of the follower elements are semi-spherical.

* * * * *